US008931318B2

(12) United States Patent
Bayer et al.

(10) Patent No.: US 8,931,318 B2
(45) Date of Patent: Jan. 13, 2015

(54) DEVICE AND METHOD FOR THE SURFACE PEENING OF A COMPONENT OF A GAS TURBINE

(75) Inventors: Erwin Bayer, Dachau (DE); Max Niegl, Munich (DE); Martin Bussmann, Schwabhausen (DE); Thomas Peschke, Groebenzell (DE)

(73) Assignee: MTU Aero Engines GmbH, Munich (DE)

( * ) Notice: Subject to any disclaimer, the term of this patent is extended or adjusted under 35 U.S.C. 154(b) by 1013 days.

(21) Appl. No.: 12/448,056

(22) PCT Filed: Dec. 5, 2007

(86) PCT No.: PCT/DE2007/002195

§ 371 (c)(1),
(2), (4) Date: Oct. 19, 2009

(87) PCT Pub. No.: WO2008/071161

PCT Pub. Date: Jun. 19, 2008

(65) Prior Publication Data

US 2010/0037669 A1 Feb. 18, 2010

(30) Foreign Application Priority Data

Dec. 13, 2006 (DE) ..... 10 2006 058 679

(51) Int. Cl.

| | |
|---|---|
| ***C21D 7/06*** | (2006.01) |
| ***B24C 1/10*** | (2006.01) |
| ***B24C 5/00*** | (2006.01) |

(52) U.S. Cl.

CPC .. *B24C 1/10* (2013.01); *B24C 5/005* (2013.01)
USPC ..... 72/53; 29/90.7

(58) Field of Classification Search

CPC ..... C21D 7/06
USPC ..... 72/53; 29/90.7, 889.7
See application file for complete search history.

(56) References Cited

U.S. PATENT DOCUMENTS

| | | | | |
|---|---|---|---|---|
| 4,432,220 | A * | 2/1984 | Loersch et al. | 72/53 |
| 6,336,844 | B1 | 1/2002 | Duquenne et al. | B24B 1/00 |
| 6,490,899 | B2 * | 12/2002 | Berthelet et al. | 72/53 |

(Continued)

FOREIGN PATENT DOCUMENTS

| | | | |
|---|---|---|---|
| EP | 1 101 568 | 2/2004 | B24C 1/10 |
| EP | 1 623 794 | 2/2006 | B24C 1/10 |

(Continued)

OTHER PUBLICATIONS

Search Report of PCT/DE2007/002195 (6 pages), Apr. 22, 2008.

*Primary Examiner* — Edward Tolan
(74) *Attorney, Agent, or Firm* — Davidson, Davidson & Kappel, LLC

(57) ABSTRACT

A device for surface-peening, especially for the ultrasound shot-peening of a component of a gas turbine, having at least one vibration means that comprises a surface that propels the peening material, and having a holding means with which a surface area of the component and the surface of the vibration means can be arranged with respect to each other is disclosed. In this context, the angular position of the surface of the at least one vibration means can be adjusted relative to the surface area of the component of the gas turbine. Moreover, a method is provided in which the angular position of the surface of the at least one vibration means can be adjusted relative to the surface area of the component.

12 Claims, 2 Drawing Sheets

(56) References Cited

U.S. PATENT DOCUMENTS

| | | | | |
|---|---|---|---|---|
| 6,517,319 | B2 * | 2/2003 | Webster et al. | 416/241 R |
| 6,837,085 | B2 | 1/2005 | Berthelet et al. | B24B 1/00 |
| 7,028,378 | B2 * | 4/2006 | Cheppe et al. | 29/90.7 |
| 7,481,088 | B2 * | 1/2009 | Bayer et al. | 72/53 |
| 7,644,599 | B2 * | 1/2010 | Hoffmann-Ivy et al. | 72/53 |
| 7,647,801 | B2 * | 1/2010 | Cheppe et al. | 72/53 |
| 7,691,211 | B2 * | 4/2010 | Lu et al. | 148/240 |
| 7,703,312 | B2 * | 4/2010 | David | 72/53 |
| 7,805,972 | B2 * | 10/2010 | Prevey, III | 72/407 |
| 7,992,416 | B2 * | 8/2011 | Stonitsch et al. | 72/53 |
| 8,091,192 | B2 * | 1/2012 | Bayer et al. | 29/90.7 |
| 8,256,117 | B2 * | 9/2012 | Hennig | 29/889.7 |
| 2006/0174483 | A1 | 8/2006 | Bayer et al. | B23P 15/04 |
| 2006/0252357 | A1 | 11/2006 | Bohler | B24C 3/00 |
| 2010/0125990 | A1 * | 5/2010 | Bayer et al. | 29/90.7 |

FOREIGN PATENT DOCUMENTS

| | | | |
|---|---|---|---|
| FR | 2 689 431 | 10/1993 | B24C 1/10 |
| WO | WO 9320247 A1 * | 10/1993 | C21D 7/06 |
| WO | WO 02/24411 | 3/2002 | B24B 39/00 |
| WO | WO 2005/123338 | 12/2005 | B24B 39/00 |

* cited by examiner

DEVICE AND METHOD FOR THE SURFACE PEENING OF A COMPONENT OF A GAS TURBINE

Priority is claimed to German Patent Application DE 10 2006 058 679.4, filed Dec. 13, 2006 through international application PCT/DE2007/002195, filed Dec. 5, 2007, the entire disclosures of which are hereby incorporated by reference herein.

BACKGROUND OF THE INVENTION

The invention relates to a device for surface-peening, especially for the ultrasound shot-peening of a component of a gas turbine, having at least one vibration means that comprises a surface that propels the peening material, and having a holding means with which a surface area of the component and the surface of the vibration means can be arranged with respect to each other and to a method for surface-peening, especially for the ultrasound shot-peening of a component of a gas turbine in which a surface area of the component and at least one surface of the vibration means that propels the peening material are arranged with respect to each other and can be moved with respect to each other during the surface-peening.

Such a device and such a method are already known as prior art from European patent application EP 1 101 568 B1, whereby the rotor blades of a rotor configured as a blisk can be shot-peened for purposes of improving their fatigue strength. The device here comprises a holding means on which the rotor is held so as to be rotatable around its rotational axis. As the rotor turns, its blades pass through a peening chamber at the bottom of which there is a vibration means in the form of an ultrasound sonotrode having at least one vibrating surface that runs approximately horizontally. The peening chamber is delimited axially—that is to say, in the area of the wide sides of the rotor—as well as radially—in other words, in the area of the rotor blades of the blisk—by corresponding chamber walls. Since, depending on the position of each of the rotor blades, especially the walls of the peening chamber arranged radially with respect to the rotor are not capable of holding all of the balls inside the central peening chamber, two additional chambers are arranged upstream or downstream from the central peening chamber in the radial direction of the rotor. Balls that overflow from the central peening chamber fitted with the sonotrode are collected inside these additional chambers and returned via appropriate channels.

In this prior-art device and in the appertaining method, however, it can be considered as disadvantageous that it is very difficult to attain a uniform hardening of the surface areas of the rotor blades that are to be peened. This is also due to the fact that the rotor blades have a twist relative to their center axis or relative to the perpendicular to the rotational axis of the rotor.

SUMMARY OF THE INVENTION

Consequently, the objective of the present invention is to create a device as well as a method of the above-mentioned type by means of which various surface areas of the component can be hardened more systematically and more uniformly.

In order to allow various surface areas of components of the gas turbine to be hardened more systematically and more uniformly by surface-peening, it is provided according to the invention that the angular position of the surface of the at least one vibration means can be adjusted relative to the surface area of the component of the gas turbine. For this purpose, with the method, it is provided according to the invention that the angular position of the surface of the vibration means can be adjusted relative to the surface area of the component before and/or during the surface-peening.

In other words, it is thus provided according to the invention that a device as well as a method for surface-peening are created with which the angular positions of the surface of the at least one vibration means and of the surface area of the component can be adjusted relative to each other in such a way that the specific surface area that is to be worked can be optimally peened with peening material. Since, for example, the twist of each rotor blade around its center axis or its perpendicular to the rotational axis of the rotor causes the vector of the surface normal to change markedly over the geometry of the blade, the fact that the surface of the vibration means can be adjusted now makes it possible to correspondingly adjust its normal vector. In other words, the surface of the vibration means, for instance, can now be adjusted in such a way that its normal vector—directly or at the desired angle—faces the surface area of the component that is to be worked. Since the angle at which the peening material is propelled from the surface of the vibration means against the surface area of the component that is to be worked has a decisive influence on the extent of the hardening, the latter can be systematically and uniformly adjusted by appropriately adjusting the angular position of the surface of the vibration means.

As a result, it can be seen that a systematic and uniform hardening of the surface of the component that is to be worked can be achieved in that the relative positions of the surface of the sonotrode and of the surface area that is to be worked are appropriately varied. In this context, it is conceivable to configure the surface of the vibration means so that it can be adjusted relative to the surface area that is to be worked as well as vice versa, namely, the surface area of the component can be adjusted—for example, using the holding means—relative to the surface of the vibration means.

Since the component of the gas turbine itself is secured by the holding means, the surface quality or the hardening of the surface area of the component to be worked can be reproduced very accurately. In other words, it can be ensured that the peening intensity of the surface-peening remains extremely homogenous within very narrow limits over the entire peening area.

The advantages of the device according to the invention cited below are also to be considered as advantages of the method according to the invention.

In another embodiment of the invention, it has also proven to be advantageous if the angular position of the surface of the at least one vibration means can be adjusted relative to the surface area during the surface-peening of the surface area of the component. As a result, various surface areas of the component can be worked individually by means of a surface-peening that is harmonized with said areas. Since, in each case, the angular position of the surface of the vibration means can be adjusted relative to the surface area that is to be worked, the peening intensity and the striking angle of the peening material can be harmonized with the surface area of the component that is to be worked. Here, for example, the rotor blades can be peened in a continuous or multiple-step process in that the rotor is turned at a certain speed. Consequently, the angular position of the surface of the vibration means changes as it adapts to the speed.

In another advantageous embodiment of the invention, two vibration means are provided which each have surfaces that are at an angle relative to each other. This makes it easy to work a component on both sides simultaneously, so that even complex three-dimensional component geometries can be peened in an optimal manner. The simultaneous surface-peening on both sides entails the major advantage that, in particular, thin areas of the component do not become warped.

In this context, it has also proven to be advantageous for the appertaining surfaces of the two vibration means to be arranged so as to be essentially in a V-shape with respect to each other. The angular positions of these two surfaces can be adapted to each other very easily so that, especially in the case of peening on both sides, the surface areas that are directly across from each other can be peened simultaneously. A mirror-symmetrical arrangement provides that the appertaining surfaces of the two vibration means intersect each other at least approximately in a center axis or in a perpendicular of the component.

In another embodiment of the invention, the at least one adjustable surface of each vibration means can be adjusted around one or two adjustment axes. These two axes run preferably perpendicular to each other, so that a tilt angle and a rotational angle can easily be set. In other words, a surface of a vibration means that has two adjustment axes is thus especially characterized in that it can be adjusted two-dimensionally. Consequently, of course, the normal vector of the surface can also be adjusted two-dimensionally.

The device according to the invention has proven to be advantageous especially in order to peen a rotor, particularly a blisk, that is held so that it can rotate around its rotational axis. Especially the rotor blades can thus be easily brought into the peening area of the vibration means by turning the rotor, whereby the adjustable surface ensures that all of the surface areas that are to be worked are impinged with the desired peening intensity.

In order to be able to create a particularly simple device that yields an easily reproducible peening result, in another embodiment of the invention, it has proven to be advantageous to associate a peening chamber with the at least one vibration means, whereby the surface area of the component that is to be worked can be positioned in said peening chamber. It is obvious that the peening chamber has to be dimensioned large enough so that the surface of the vibration means can be set in all of the desired angular positions.

In another embodiment of the invention, the peening chamber can be easily adapted to the specific component that is to be worked in that its chamber walls are designed so as to be flexible, at least in certain areas. Such a flexible jacket makes it possible, for example, to surround the entire component, thus preventing the loss of peening material. Furthermore, such flexible chamber walls ensure that they can easily fit closely against the sonotrode and against the component holder, so that here as well, there is no need to fear any loss of peening material.

It has also proven to be advantageous for the angular position of the peening chamber walls themselves to be adjustable. As a result, on the one hand, the rebounding of the peening material from the chamber walls can be influenced and, on the other hand, the chamber walls can easily be moved close to the component in question in order to create a reliable seal to prevent peening material from escaping. It goes without saying that this makes it easy to use components having different geometries and sizes.

In another advantageous embodiment of the invention, a distribution means is provided with which the peening material can be distributed over the surface of the vibration means. Owing to the slanted arrangement of the surface, it is prevented in a simple manner that peening material accumulates excessively at a low point of the surface. Instead, the distribution means can achieve a uniform distribution of the peening material, resulting in a uniform peening intensity over the entire surface and a uniform hardening of the surface area of the component.

It is possible to create a very simple distribution means if it comprises a vibrating surface which is configured, for example, as a sonotrode, a so-called flapper, a piezo shaker or a vibrating plate or membrane. As an alternative to this, the distribution means can also be operated with a compressed medium, especially with pressurized air, which can easily be adjusted in such a way that the peening material is uniformly distributed, also on the top places of the surface of the vibration means.

In another embodiment of the invention, for example, a first means for determining the quantity of peening material is provided inside the peening chamber. This means can perform, for instance, a sound analysis inside the peening chamber by means of which the quantity of peening material can be determined. This makes use of the underlying notion that the sound made by the peening material changes as a function of its quantity.

Moreover, in another embodiment of the invention, a means for refilling the peening material can be provided so as to keep the quantity of peening material constant inside the peening chamber. In particular, a uniform quantity of peening material ensures that the peening results are easily reproducible and constant.

Moreover, it has proven to be advantageous if the means for refilling the peening material can be controlled as a function of the quantity of peening material determined by the first means. In this manner, it is easy to perform monitoring, so that the same quantity of peening material is always present, for example, inside the peening chamber.

BRIEF DESCRIPTION OF THE DRAWING

Additional advantages, features and details of the invention can be gleaned from the description below of a preferred embodiment as well as on the basis of the drawings, without being limited thereto. The drawings show.

DETAILED DESCRIPTION

Figure 1:
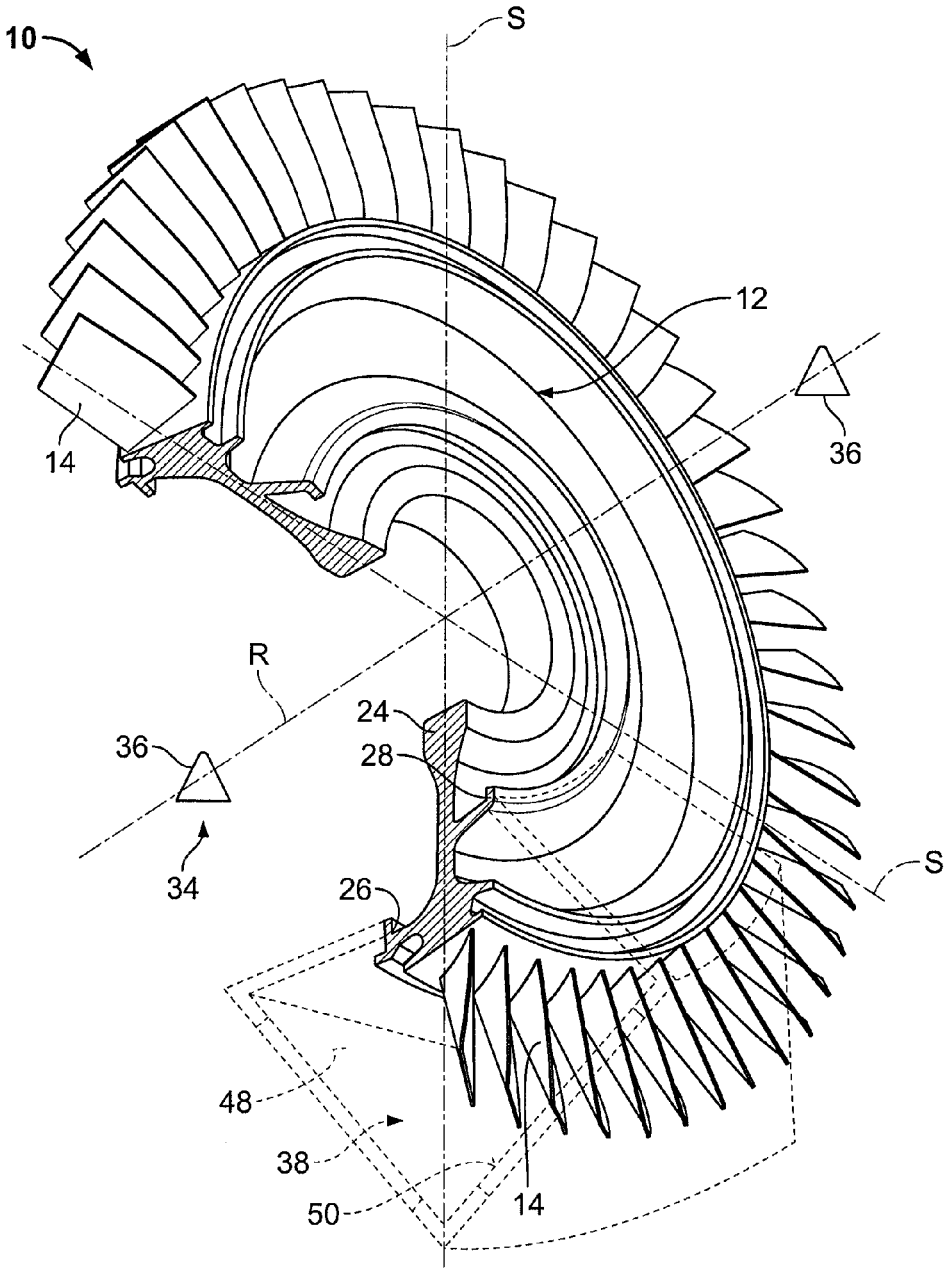
FIG. 1—a schematic perspective view of a rotor of a gas turbine—in the form of a blisk—depicted as a cutaway section that is held by means of a merely schematically indicated holding means so as to be rotatable around its rotational axis, whereby, on the bottom of the blisk in the area of the rotor blades, a schematically indicated peening chamber can be seen that comprises two surfaces—arranged in a V-shape with respect to each other—of associated vibration means with which peening material, for example, in the form of balls, can be propelled in the direction of the rotor blades; and in FIG. 2—a schematic sectional view through the blisk according to FIG. 1, whereby, in the area of the rotor blades, the device for surface-peening is depicted that here comprises two surfaces—arranged in a V-shape with respect to each other—of each of the vibration means, whereby the angular positions of these two surfaces can be adjusted relative to the blisk.

FIG. 1 schematically shows a schematic and sectional perspective view of a rotatable rotor on a gas turbine in the form of a blisk 10. The basic individual areas of the blisk 10 can be seen in greater detail in conjunction with FIG. 2, which shows a schematic sectional view of said blisk 10. In particular, especially a blisk disk 12 can be clearly seen on whose outer circumference numerous rotor blades 14 are arranged. A platform 16—shown in the form of a line in FIG. 2—can be seen on the outer circumference of the blisk disk 12 and this platform 16 is followed radially towards the inside, or upwards in the drawing, by a sub-platform area 18. This sub-platform area 18 makes a transition radially inwards into a disk neck 20 that connects the sub-platform area 18 to a disk element 22. The radial inner end of the disk element 22 is formed by a hub 24 that constitutes a counterweight to the rotor blades 14. A first wing 26, whose cross section is essentially angular, projects from the sub-platform area 18 or from the disk neck 20 on one side of the blisk disk 12. In a center area of the disk element 22—as seen in the radial direction—another wing 28 projects from the other side of the blisk disk 12, said wing comprising an angular area 30 as well as a web 32 that connects this area to the disk element 22, said web projecting at an angle of 45° relative to the disk element 22. All in all, the blisk 10 is configured to be rotatable around a rotational axis R or to be rotation-symmetrical.

As far as a device for the surface-peening of rotor blades 14 is concerned, FIG. 1 shows a holding means 34 symbolically indicated by two bearing blocks 36, by means of which the blisk is held or mounted so as to be rotatable around its rotational axis R.

Figure 2:
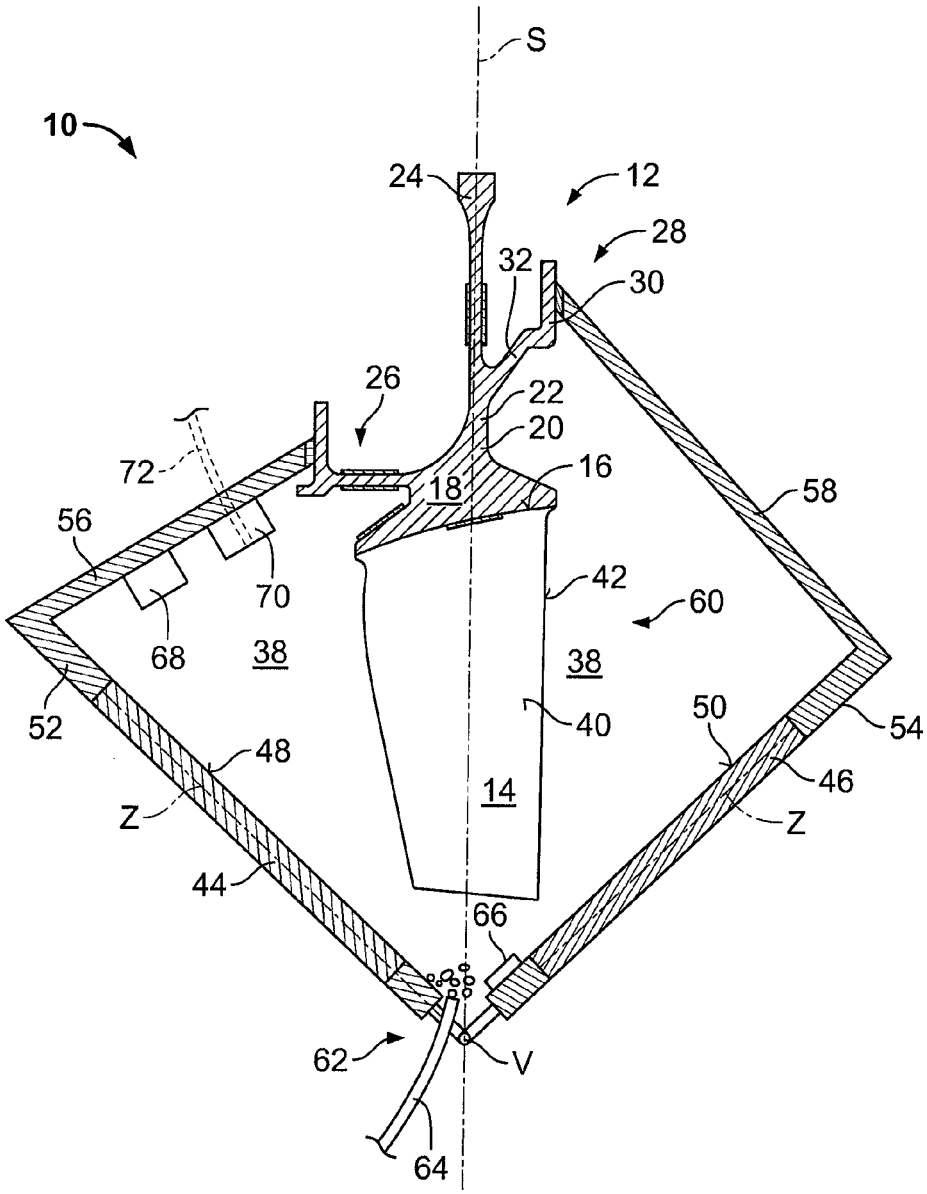

In addition to the holding means 34, the shot-peening device here comprises a peening chamber 38 that can be seen in greater detail, especially when viewed in conjunction with FIG. 2. Here, the peening chamber 38 serves to shot-peen the surface areas 40, 42 on the opposite sides of each of the rotor blades 14. In FIG. 1, the peening chamber 38 is only indicated by broken lines and shown in a cutaway view along a perpendicular S on the rotational axis R of the blisk 10 or parallel to the sectional surface through the blisk 10.

In FIG. 2, it can be seen that the peening chamber 38 comprises two vibration means 44, 46—indicated merely schematically—that are configured here as ultrasound sonotrodes. Each of the vibration means 44, 46 has a surface 48, 50 that faces the component to be peened or the appertaining rotor blade 14, said surfaces 48, 50 being configured flat in the present embodiment. In particularly, it can be seen in FIG. 2 that the surfaces 48, 50 of the two vibration means 44, 46 are arranged essentially V-shaped with respect to each other, at an angle here of about 110° to 120°. The two vibration means 44, 46 are accommodated inside appertaining chamber walls 52, 54 of the peening chamber 38. The chamber walls 52, 54 that accommodate the vibration means 44, 46 are followed at an angle by corresponding additional chamber walls 56, 58 that close off the peening chamber 38 towards the top. Furthermore, on both faces 60, chamber walls (not shown here) are provided that at least largely close off the peening chamber 38 in the radial direction of the blisk 10.

It can be seen in FIG. 2 that the angular positions of the two surfaces 48, 50 can be adjusted with respect to each other or to the component (rotor blades 14) that are to be worked. Here, the adjustment axis V runs perpendicular to the plane of the page. Besides, each of the two surfaces 50 can be adjusted around another adjustment axis Z that is only schematically indicated in FIG. 2. In each case, the second adjustment axes Z each run in the plane of the surfaces 48, 50 and perpendicular to the first adjustment axis V. In other words, each of the two surfaces 48, 50 here are adjusted at least around the adjustment axis V and optionally—if present—around the additional adjustment axis Z. Consequently, either only a given tilt angle around the axis V or else additionally a rotation angle around the appertaining axis Z can be set in the present case. It goes without saying that, as a result, a normal vector or a perpendicular to the appertaining surface 48, 50 can be adjusted either unidimensionally or two-dimensionally. Therefore, it is achieved that different partial areas of the two opposite surface areas 48, 50 of the appertaining rotor blades 14 can each be optimally hardened by means of the shot-peening. Since the rotor blades 14 each have a twist which, at different partial areas of their surface areas 40, 42, causes the vector of the surface normals to change markedly over the blade geometry, said change can be compensated for by appropriately adjusting the angle of the two surfaces 48, 50 of the two vibration means 44, 46. Depending on the angular position of the two surfaces 48, 50, the striking angle of the peening material can be adjusted to the partial surface areas 40, 42 to be peened, thus achieving optimal or individual hardening. The angular position of the surfaces 48, 50 can be adjusted during the surface-peening of the rotor blade 14 in question, so that each rotor blade 14 can be surface-peened in a single work step. If the blisk 10 is rotated stepwise or continuously around its rotational axis R inside the holding means, then an adjustment can likewise be carried out by via the surfaces 48, 50.

As an alternative, of course, in an especially simple embodiment, it would naturally also be conceivable to configure the surfaces 48, 50 so that they can only be adjusted in advance, whereby then the entire work process is carried out with the surfaces 48, 50 that have been adjusted in this manner. This would be conceivable, for example, if the component to be worked has a relatively simple geometry. It is clear that the chamber walls 52, 54, 56, 58 have to be appropriately configured so that the surfaces 48, 50 of the two vibration means 44, 46 can be adjusted. Here, it would be conceivable, for instance, to employ flexible chamber walls 52, 54, 56, 58 that, in a simple manner, can even surround the entire component. This would create a flexible jacket that surrounds the entire component and fits closely against the side surfaces of the vibration means 44, 46 and, if applicable, also against component holders (not shown here). In an embodiment not shown here, especially the chamber walls 56, 58 that are located opposite from the surfaces 48, 50 can likewise be configured so as to be adjustable in order to allow an appropriate adaptation to the slanted positioning of the vibration means 44, 46. In addition, adjustable chamber walls 56, 58 can be employed to influence the deflection angle at which the peening material rebounds from the walls.

As a result of the V-arrangement of the two surfaces 48, 50, it is possible, in particular, to simultaneously peen opposite surface areas 40, 42 of the appertaining rotor blades 14. As a result, warping is prevented, especially in the case of components having fairly thin walls. Moreover, the adjustment of the angular positions of the surfaces 48, 50 makes it possible to achieve a homogenous peening intensity over the entire peening area within narrow limits. In the present embodiment, the surfaces 48, 50 are arranged at an identical angle relative to the perpendicular S, which constitutes a center axis through the appertaining rotor blade 14. By the same token, of course, it would likewise be conceivable to set both surfaces 48, 50 at different angles by means of the adjustment axes V and Z.

The two surfaces 48, 50 can theoretically be set at an angle ranging from 0° to 90°, especially from 0° to 80°, relative to the perpendicular S or to the center axis of the appertaining rotor blades 14. An angle of the two surfaces 48, 50 with respect to the perpendicular S that is likewise well-suited is between about 30° and 60°, especially between 40° and 50°.

At the lowest point of the two surfaces 48, 50, a distribution means 62 is provided with which the peening material—primarily the balls—can be uniformly distributed over the two surfaces 48, 50. This likewise homogenizes the peening intensity. In the present embodiment, the distribution means 62 comprises a hose 64 through which pressurized air or compressed air can be fed in at the lowest point in the peening chamber 38, so that peening material that is accumulating there can be moved upwards and uniformly distributed over the surfaces 48, 50. As an alternative to the hose 64, a vibrating surface 66 can also be provided, which is likewise schematically indicated in FIG. 2. In this context, the vibrating surface 66 can be operated by a sonotrode, a flapper, a piezo shaker or a vibrating plate or membrane. The result is that the peening material is uniformly distributed over the surfaces 48, 50.

Moreover, a first means 68 with which the quantity of peening material can be ascertained is provided inside the peening chamber 38. This can be done, for instance, on the basis of a sound analysis in which the sound in the peening chamber 38 is measured as a function of the quantity of peening material. When the value falls below a given threshold limit, additional peening material can be refilled with a second means 70, as indicated by the hose 72 drawn with a broken line. The result is that a constant quantity of peening material is always present inside the peening chamber 38, so that the peening results obtained are reproducible.

Therefore, for purposes of the surface-peening, the surface areas 40, 42 of the component 14 and the surfaces 48, 50 of the vibration means 44, 46 can be arranged relative to other by means of the holding means 32 and can be moved relative to each other by rotating the blisk 10 around its rotational axis R during the surface-peening. The angular position of the surface 48, 50 of the at least one vibration means 44, 46 relative to surface area 40, 42 of the component 14 can be adjusted either only in advance and/or during the surface-peening of the surface area 40, 42 of the component 14 so that the surface areas 40, 42 can be hardened systematically and uniformly.

The invention claimed is:

1. A device for surface-peening, especially for the ultrasound shot-peening of a component of a gas turbine, the component being a rotor having a hub and blades extending radially from the hub, the device comprising:

a peening chamber including a first vibrator having a first surface and a second vibrator having a second surface, the first and second surfaces forming a V-shape and being adjustable with respect to each other, the peening chamber including a first wall connected to the first vibrator and a second wall connected to the second vibrator, the first and second walls defining an opening therebetween for accepting the blades of the rotor and contacting the rotor so that the blades are within the peening chamber while the hub remains outside peening chamber; and a holder capable of holding the rotor so that the blades can rotate with respect to the peening chamber.

2. The device as recited in claim 1, wherein the rotor is a blisk.

3. The device according to claim 1, further comprising a distributor with which the peening material can be distributed over the surface of the first and second vibrators.

4. The device according to claim 3, wherein the distributor is arranged below a lowest point of the surface of the first and second vibrators.

5. The device according to claim 3, wherein the distributor comprises a surface that propels the peening material, or else the distributor can be operated with a compressed medium with which the peening material can be uniformly distributed over the surface of the first and second vibrators.

6. The device according to claim 5, wherein the compressed medium is pressurized air.

7. The device according to claim 1, further comprising a first means for determining the quantity of peening material.

8. The device according to claim 1, further comprising a second means for refilling peening material.

9. The device according to claim 8, wherein the second means can be controlled as a function of the quantity of peening material determined by a first means for determining the quantity of the peening material.

10. The device according to claim 1, wherein the first and second vibrators are adjustable about an axis perpendicular to a center axis of the turbine blade then being peened to adjust an angle between the first and second surfaces.

11. The device as recited in claim 1 wherein the first and second walls are flexible.

12. The device as recited in claim 10 wherein the angle is adjustable between 60 and 120 degrees.

* * * * *